US009016008B2

(12) United States Patent
Knighton

(10) Patent No.: US 9,016,008 B2
(45) Date of Patent: Apr. 28, 2015

(54) ROOFING CAP SYSTEM

(71) Applicant: Ronald Knighton, Fullerton, CA (US)

(72) Inventor: Ronald Knighton, Fullerton, CA (US)

( * ) Notice: Subject to any disclaimer, the term of this patent is extended or adjusted under 35 U.S.C. 154(b) by 0 days.

(21) Appl. No.: 14/159,296

(22) Filed: Jan. 20, 2014

(65) Prior Publication Data

US 2014/0202093 A1 Jul. 24, 2014

Related U.S. Application Data

(60) Provisional application No. 61/754,907, filed on Jan. 21, 2013.

(51) Int. Cl.

| | |
|---|---|
| ***E04B 7/00*** | (2006.01) |
| ***E04H 12/28*** | (2006.01) |
| ***E04D 13/17*** | (2006.01) |

(52) U.S. Cl.

CPC ..... *E04D 13/174* (2013.01)

(58) Field of Classification Search

CPC ..... E04D 13/174; E04D 13/17; E04D 13/158; E04D 1/30; E04D 2001/305; E04B 1/7069; E04B 1/70

USPC ..... 52/198, 199, 95, 302.3; 454/364–366

See application file for complete search history.

(56) References Cited

U.S. PATENT DOCUMENTS

| | | | | | |
|---|---|---|---|---|---|
| 4,280,399 | A * | 7/1981 | Cunning | 454/365 |
| 4,907,499 | A * | 3/1990 | James | 454/365 |
| 5,092,225 | A * | 3/1992 | Sells | 454/365 |
| 5,112,278 | A * | 5/1992 | Roberts | 454/365 |
| 5,605,022 | A * | 2/1997 | Fulton | 52/199 |
| 5,921,863 | A * | 7/1999 | Sells | 454/359 |
| 6,077,159 | A * | 6/2000 | Clayton | 454/250 |
| 6,125,602 | A * | 10/2000 | Freiborg et al. | 52/560 |
| 6,308,472 | B1 * | 10/2001 | Coulton et al. | 52/198 |
| 8,291,655 | B2 * | 10/2012 | McGlothlin | 52/198 |
| 2001/0052207 | A1 * | 12/2001 | Davis | 52/199 |
| 2005/0166489 | A1 * | 8/2005 | Jolitz | 52/198 |
| 2008/0078132 | A1 * | 4/2008 | Jolitz | 52/276 |
| 2008/0216442 | A1 * | 9/2008 | Shubin | 52/741.4 |
| 2010/0154337 | A1 * | 6/2010 | Krenz | 52/302.3 |
| 2010/0275542 | A1 * | 11/2010 | Ward et al. | 52/309.1 |
| 2011/0209423 | A1 * | 9/2011 | McGlothlin | 52/198 |
| 2011/0308178 | A1 * | 12/2011 | Daddio | 52/198 |
| 2013/0019548 | A1 * | 1/2013 | Daniels | 52/198 |

* cited by examiner

*Primary Examiner* — Brian Glessner
*Assistant Examiner* — Brian D Mattei
(74) *Attorney, Agent, or Firm* — Knobbe, Martens, Olson & Bear, LLP

(57) ABSTRACT

A vented ridge cap assembly can include an upper ridge cap member and one or more non-continuous members configured to support the ridge cap member at a position spaced above a roof of a structure. The non-continuous members include one or more gaps to allow air to pass there through. The ridge cap assembly can optionally include a non-continuous member with one or more folds so as to define two or more parallel walls which can provide enhanced rigidity and/or wind resistance. Optionally, the roof cap assembly can include lower mounting portions for mating with upper surface of a roof structure.

19 Claims, 11 Drawing Sheets

ROOFING CAP SYSTEM

RELATED APPLICATIONS

The present application claims priority to U.S. Provisional Application No. 61/754,907, filed Jan. 21, 2013, the entire content of which is hereby expressly incorporated by reference.

FIELD OF THE INVENTIONS

The present inventions are related to roofing products, such as roofing components designed for ventilation.

BACKGROUND OF THE INVENTIONS

Recently, construction regulations have adopted requirements associated with attic space ventilation. Specifically, some regulations require that the ridge of a roof, i.e., the area in the vicinity of the uppermost intersection of two portions of roof that slant away from each other, must be vented.

Such venting can be provided by holes disposed near the apex of a roof, for example, leaving gaps between the uppermost edges of the sheathing of roofing, or drilling holes in the sheathing. In some designs where the uppermost edge of the sheathing is nailed into the top surface of a ridge beam, holes are drilled through the sheathing near or partially overlapping the ridge beam. Such ventilation holes can be covered with ventilated ridge caps designed to accommodate airflow and prevent water intrusion.

SUMMARY OF THE INVENTIONS

An aspect of at least one of the inventions disclosed herein includes the realization that certain roofing products can be prefabricated to accommodate roofing features, such as vented ridges, so as to reduce manufacturing costs and reduce the labor required for installation. For example, some roof designs include vented ridges which allow air to escape from the interior space to the exterior of the building. However, holes or gaps on the roof creates a need for preventing water and other debris from entering.

Thus, in accordance with an embodiment, a vented ridge cap comprises a peaked ridge cap member and at least one vented leg member connected to the ridge cap member and comprising a downward projection configured to support the peaked ridge cap at a position spaced above a roof ridge. Such a configuration can be manufactured in long strips and at low cost with commercially available rolling and cutting machines.

Another aspect of at least one of the inventions disclosed herein includes the realization that prefabricated roofing products, such as those designed for ridge caps, can utilize non-continuous materials as structural components to provide both a structural function as well as a ventilation function. Additionally, non-continuous sheet material can be formed into multiple layers to provide both enhanced structural function as well as baffling for protection against, for example, wind-driven rain.

Thus, in accordance with an embodiment, a ridge cap assembly can comprise a peaked ridge cap member and at least one spacer member comprising a projection extending transversely and downwardly from one lateral edge of the peaked ridge cap member, the spacer member comprising at least two layers of non-continuous material, both layers extending transverse to a direction of airflow through the spacer member and configured to support the peaked ridge cap at a position spaced above a structural roof surface.

Another aspect of at least one of the inventions disclosed herein includes the realization that a vented ridge cap assembly can further benefit from including an additional generally planar portion extending from a lower end of a spacer portion, and configured to lie against a structural surface of a roof such that appropriate connection can be made to the surrounding roofing material, such as shingles or other materials.

In accordance with another embodiment, a vented ridge cap assembly can comprise a peaked ridge cap member and at least one non-continuous member having a lower mounting flange for fixation to a roof of a structure, an upper flange designed for fixation to a lower surface of the peaked ridge cap member, and in intermediate, non-continuous portion disposed between the upper and lower flanges and configured to accommodate restricted airflow therethrough. In some embodiments, the lower mounting flange, upper flange, and the intermediate, non-continuous portion can be made from a single piece of bent sheet metal.

DETAILED DESCRIPTION OF THE PREFERRED EMBODIMENT

Embodiments of a prefabricated roofing component are described below in the context of vented ridge caps which can be used for ventilated roof ridges because these embodiments have particular utility in this context. However, the inventions disclosed herein can be used in other contexts as well, such as for example, but without limitation, roof hips.

Figure 1:
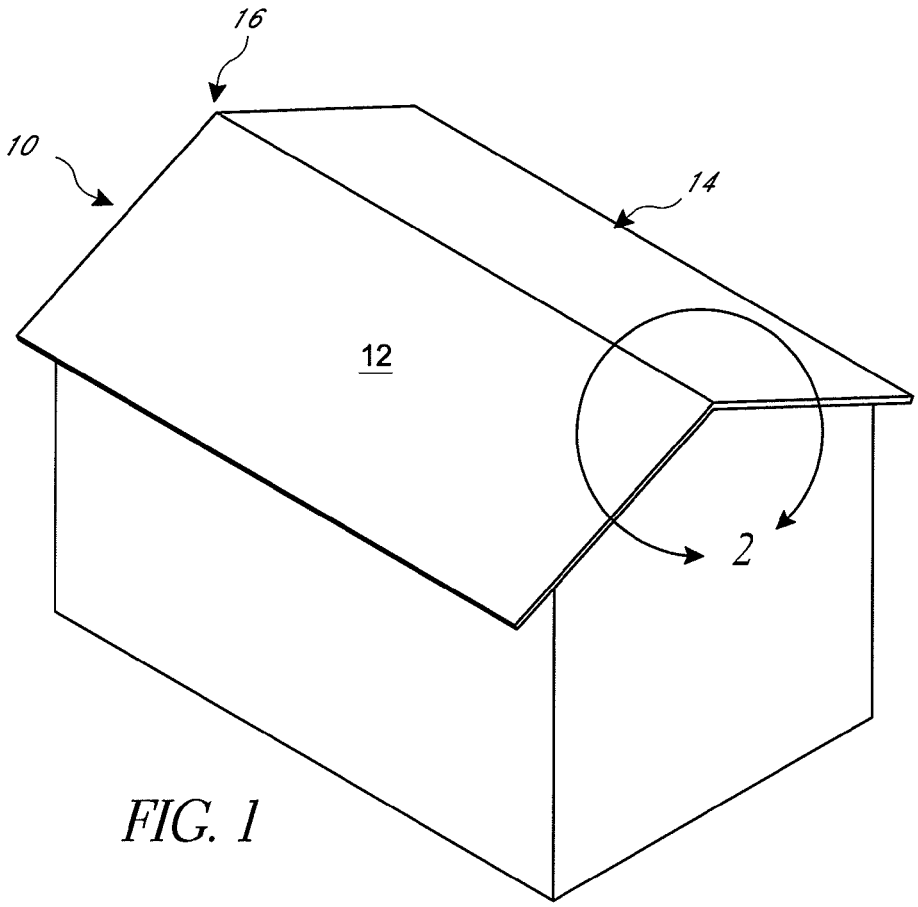
FIG. 1 is a perspective schematic view of a small structure having a pitched roof.

FIG. 1 illustrates a simple building including a pitched roof. Such a roof is typically constructed with outer sheathing 12, 14 disposed on either side of an apex of a ridge 16 of the roof of the building 10.

Figure 2:
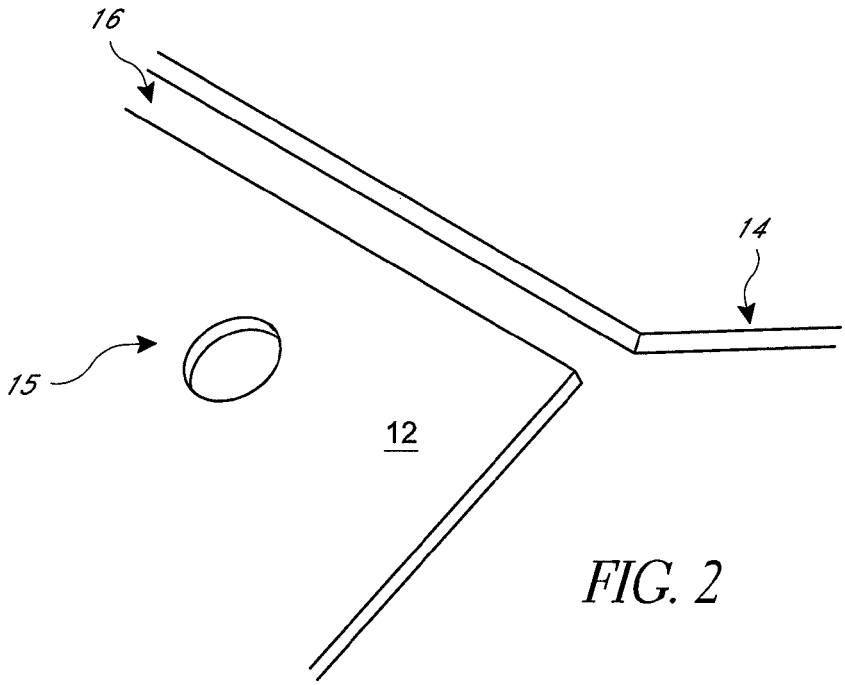
FIG. 2 is an enlarged schematic drawing of the identified portion of FIG. 1, illustrating a gap between adjacent sheathing members and holes in the sheathing of a roof providing for ventilation for an attic space below the sheathing.

The enlargement of FIG. 2 shows a type of construction in which the sheathing portions 12, 14 disposed on opposite sides of the ridge 16 are spaced apart from one another at the apex of the roof of the structure 10. Other structural components within the structure 10, such as various beams and tresses, are secured to the sheath members 12 and 14. In some other known designs, there is no gap between the sheathing members 12, 14, and holes 15 are drilled though the sheathing members 12, 14, as illustrated in FIG. 2.

Figure 3:
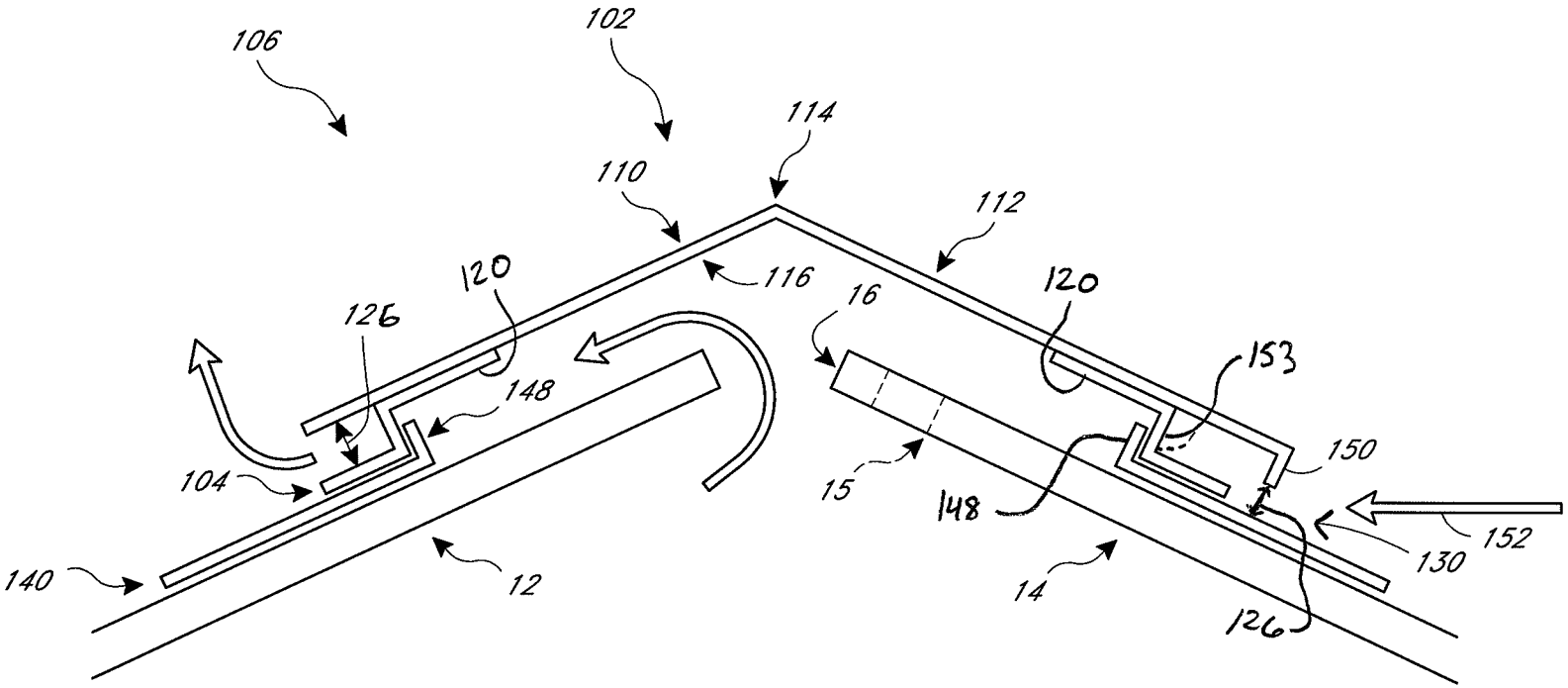
FIG. 3 is an end view of an embodiment of a vented ridge cap mounted onto two adjacent sheathing members at the ridge of a roof.
Figure 4:
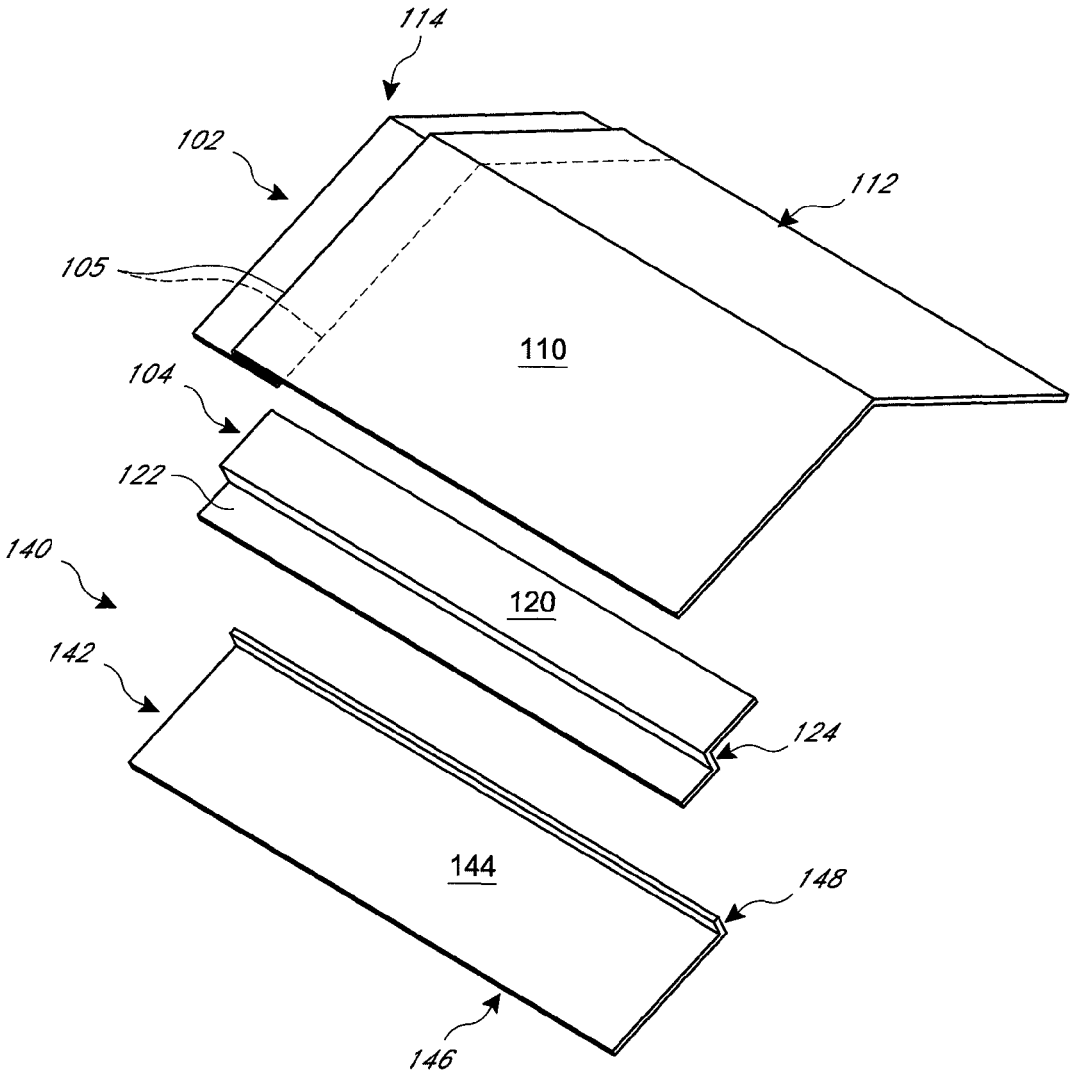
FIG. 4 is a partial perspective and exploded view of the vented ridge cap of FIG. 3.

With reference to FIGS. 3 and 4, a vented ridge cap assembly 100 can include a peaked roof cap member ridge cap member 102 and at least one non-continuous member 104.

The peaked ridge cap member 102 can include first and second side portions 110, 112 that are connected to each other along a ridge line 114. The ridge line 114 can form an apex of the vented ridge cap assembly 100, when it is installed onto a roof. The ridge cap member 102 can be formed from any material including, for example, but without limitation, sheet metals, composites, or any desired material. In some embodiments, the ridge cap member 102 can be made from steel commonly used in metal roofing applications having a standard gauge thickness, such as 26, 29 or other gauge thicknesses. Other thicknesses and materials can also be used.

Additionally, the ridge cap member 102 can include an outer exterior surface treatment, such as paint, asphalt, stone coating, or other surface treatments. Such coatings for metal roofing are well known in the art and thus are not described in greater detail below. Additionally, the outer exterior surface treatment can be the same color as the surrounding roofing product.

The non-continuous member 104 is configured to be sufficiently strong to support part or all of the ridge cap member 102 above a ventilated portion of a roof of a structure. The non-continuous member 104 can be made from standard material configurations, such as but without limitation, expanded metal, mesh, welded wire, or other non-continuous material configurations that have holes large enough to allow air to flow therethrough. For example, the non-continuous member 104 can be made from steel of a standard gauge thickness noted above, with holes having a 1/16" diameter spaced 3/16" apart. Other sizes and spacings can also be used.

In the embodiments of FIGS. 3 and 4, the non-continuous member 104 is made from a sheet material and has a generally z-shaped configuration including an upper flange 120, a lower flange 122 and an intermediate wall portion 124. In some embodiments, the upper flange 120 is configured for mating with a lower surface 116 of the ridge cap member 102. Similarly, the lower flange 122, in some embodiments, is configured to extend in a direction generally parallel to a roof of a structure, such as the sheath member 12 (FIG. 3). The wall member 124 extends at an angle generally transverse to the flanges 120, 122 so as to maintain a spacing 126 between planes along which the flanges 120, 122 may extend.

In some embodiments, the vented ridge cap assembly 100 can include a second non-continuous member 130 connected to the other portion 112 of the ridge cap member 102. Thus, the non-continuous members 104, 130 can cooperate to structurally maintain the ridge cap member 102 in a position spaced above an apex formed by the upper edges of the sheath members 12, 14. As such, the spacing provided helps to allow air to easily flow upward through the gap between the sheath members 12, 14 and through one or both of the non-continuous members 104, 130.

In some embodiments, a vented ridge cap assembly having the ridge cap member 102 and one or both of the non-continuous members 104, 130 can be secured to portions of a roof, such as sheath members 12, 14 by nailing or gluing the lower flanges 120 to the sheath members 12, 14. Other roofing materials, such as asphalt shingles, can then be applied to the remaining portion of the sheath members 12, 14, in the manner well known in the art and described below with reference to FIG. 7.

Optionally, the vented roof cap assembly 100 can further include one or more mounting portions 140. The mounting portions 140 can include a main portion 142 which can have a generally planar configuration appropriate for providing a mating contact with an upper surface of a portion of a roof, such as a sheath member 12, a shingle, or other roofing structure.

The non-continuous member 104 can be attached to both the ridge cap member 102 and the mounting portion 140 with any type of attachment device or technique including welding, rivets, threaded fasteners, adhesives, etc. In some embodiments, the upper flange 120 is attached to the lower surface 116 of the ridge cap member 102. The flange 122 of the non-continuous member 104 can be attached to the upper surface 144 of the mounting portion 140.

Optionally, the non-continuous member 104 can be constructed without the upper and lower flanges 120, 122. In such a configuration, the upper and lower edges of the intermediate wall portion 124 can be attached to the lower surface 116 and the upper surface 144 with an appropriate technique, such as welding, bonding or otherwise.

Optionally, the mounting portion 140 can include a further reinforcement wall 148 configured to extend along at least a portion of the upstanding wall 124. As such, the portion 148 can provide further rigidity to the connection between the mounting portion 140 and the non-continuous member 104.

Along those lines, the upper and lower flanges 120, 124 of the non-continuous member 104 and the mounting portion 140 can cooperate to provide substantial structure stiffness to a complete assembly 100. For example, the non-continuous member 104, being formed from material in a non-continuous configuration, such as expanded, punched or drilled sheet steel, can generally be flexible when in the form in which this material is commonly available; a flat sheet configuration. Thus, by bending the material forming the non-continuous member 104 for connecting the non-continuous member 104 to the ridge cap member 102 and optionally the mounting portion 140, the entire assembly 100 can be provided with greater stiffness. This can be helpful for installers who often need to transport, cut, and dry fit the assembly 100 onto a roof structure before final installation.

With continued reference of FIG. 3, the ridge cap member 102 can also include an optional extension lip 150 disposed at the lower edge of one or both of the first and second portions 110, 112. The extension lip 150 can be configured to provide additional deflection, baffling, or slowing of a lateral wind, which may include entrained raindrops (wind-blown rain), represented by the arrow 152. For example, in the illustrated embodiment, the extension 150 extends transversely to the second side 112 of the ridge cap member 102, and downwardly to a distal, lower-most edge 151.

In some embodiments, the extension lip 150 is sufficiently long such that the lower most edge 151 extends to a position that is lower than a lower-most opening 153 of the non-continuous member 104. In the illustrated embodiment, the lower-most opening in the non-continuous member 104 is above the lower end of the non-continuous member because the flange 148 covers the lower end of the non-continuous member 104. Thus in embodiments with a smaller flange 148, a perforated flange 148, or no flange, the lower-most opening 153 of the non-continuous member 104 can be at a lower end of the non-continuous member 104 (position identified as 153 with phantom lead line). In some embodiments, the lowermost edge of the second side 112 or the lowermost edge 151 of the extension 150 is at a position lower than the lower most edge of the non-continuous member 104.

As is known in the art, shingles are typically applied to sheath members 112, 114, starting at the lowermost edges of the roof, and working upwardly. Before reaching the vicinity of the apex 16, a roof installer could fit the assembly 100 onto the sheaths 12, 14, as illustrated in FIG. 3. When the assembly 100 is in the desired orientation, the installer can attach the mounting members 140 to the sheaths and sheath members 12, 14 with any desired technique. In some installations, it may be beneficial to use an adhesive to bond the main portion 142 of the mounting member 140 to an upper surface of the sheath members 12, 14. However, installers may choose to nail the main portion 142 to the sheaths 12, 14.

Composite shingles can then be inserted into the spacing 126. In some embodiments, the spacing can be about ½", ⅝", or ¾". Such a spacing is generally large enough to accommodate two layers of typical composite shingle that is presently commercially available from several different manufacturers. With such shingles (not shown) inserted into the spacing 126, the fasteners used to secure the flange 140 to the sheathing 14, 16 can be covered, and thus weatherproofed, by the shingles. As such, the flange 140 can serve as flashing.

In other optional installations, roofing materials, such as shingles, can be installed up to the apex 16 of the sheath members 12, 14, and then the mounting portions 140 can be mounted on top of such shingles, for example, with nailing or adhesives.

Optionally, the ridge cap member 102 can include surface features designed to provide a desired aesthetic appearance. For example, some known ridge caps are formed from individual shingles manually installed. This creates a nested appearance with seams that extend transverse to the longitudinal direction of the ridge cap.

Figure 5:
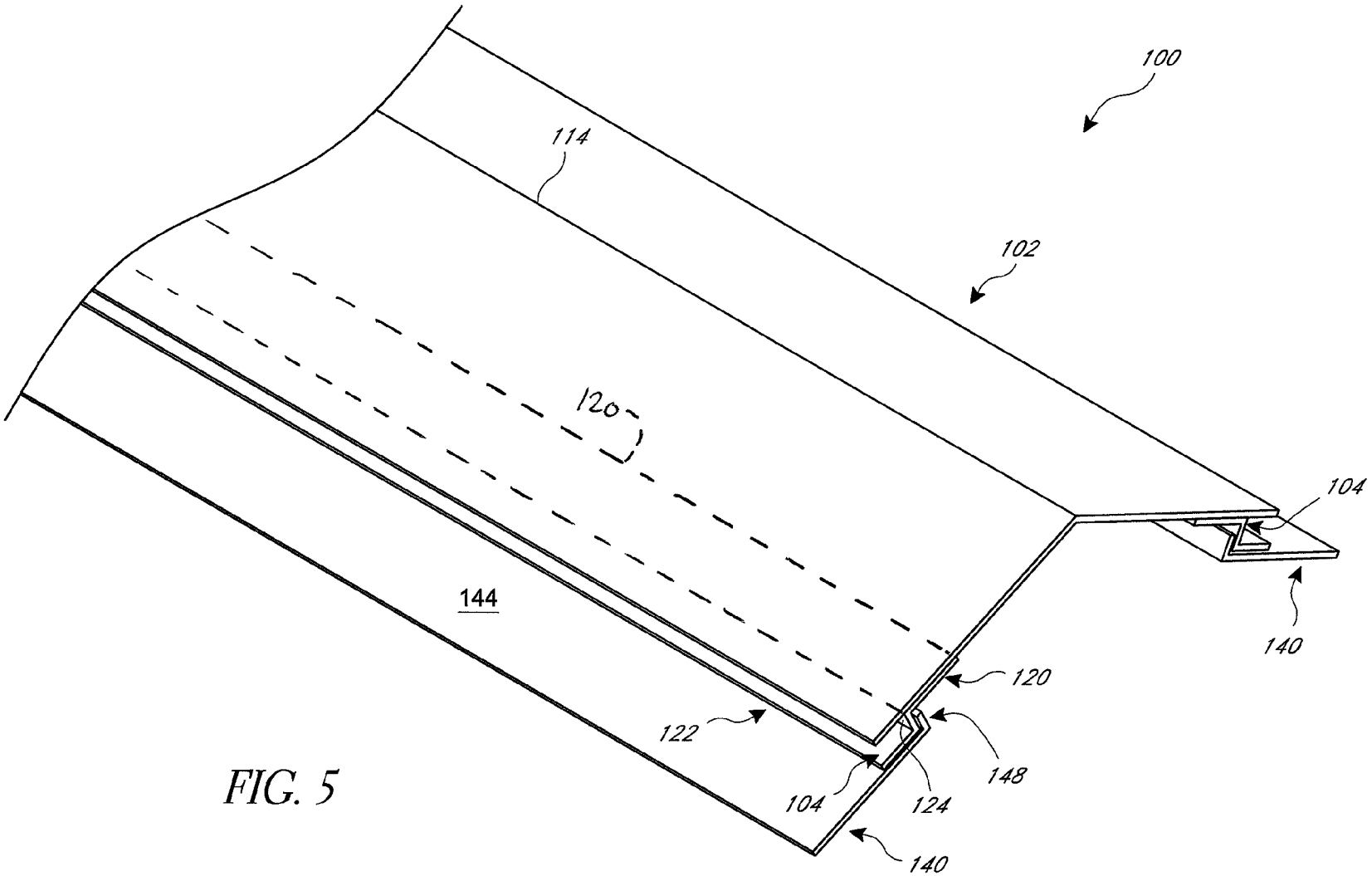
FIG. 5 is a perspective view of the vented ride cap of FIGS. 3 and 4.
Figure 6:
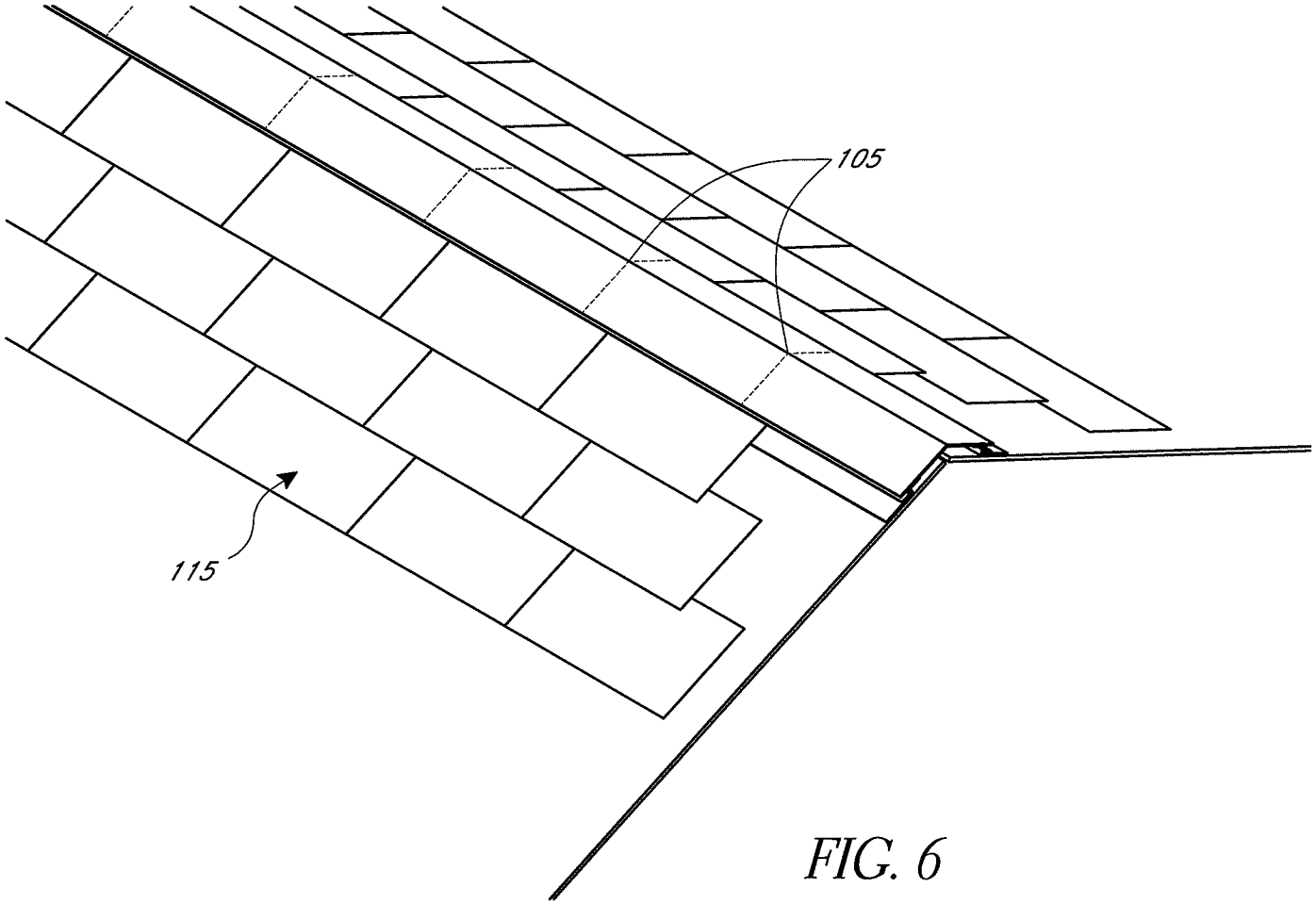
FIG. 6 is a schematic perspective view of the vented ridge cap of FIGS. 3-5 mounted onto a roof with roofing shingles mounted adjacent thereto.

Thus, in some embodiments, the ridge cap member 102 can be provided with folds 105 (phantom line FIGS. 4-6). Such folds can be created by known rolling machines such that long, monolithic ridge cap members 102 can be manufactured with a plurality of folds that resemble a connection between adjacent ridge cap shingles, without the need for creating a plurality of individual ridge cap members 102 connected together. Rather, the folds can merely resemble the look of conventionally installed ridge caps made from composite shingles.

In other embodiments, the assembly 100 can include folded portions at both ends, configured to provide for connecting a plurality of assemblies 100 in an end-to-end fashion.

Figure 7:
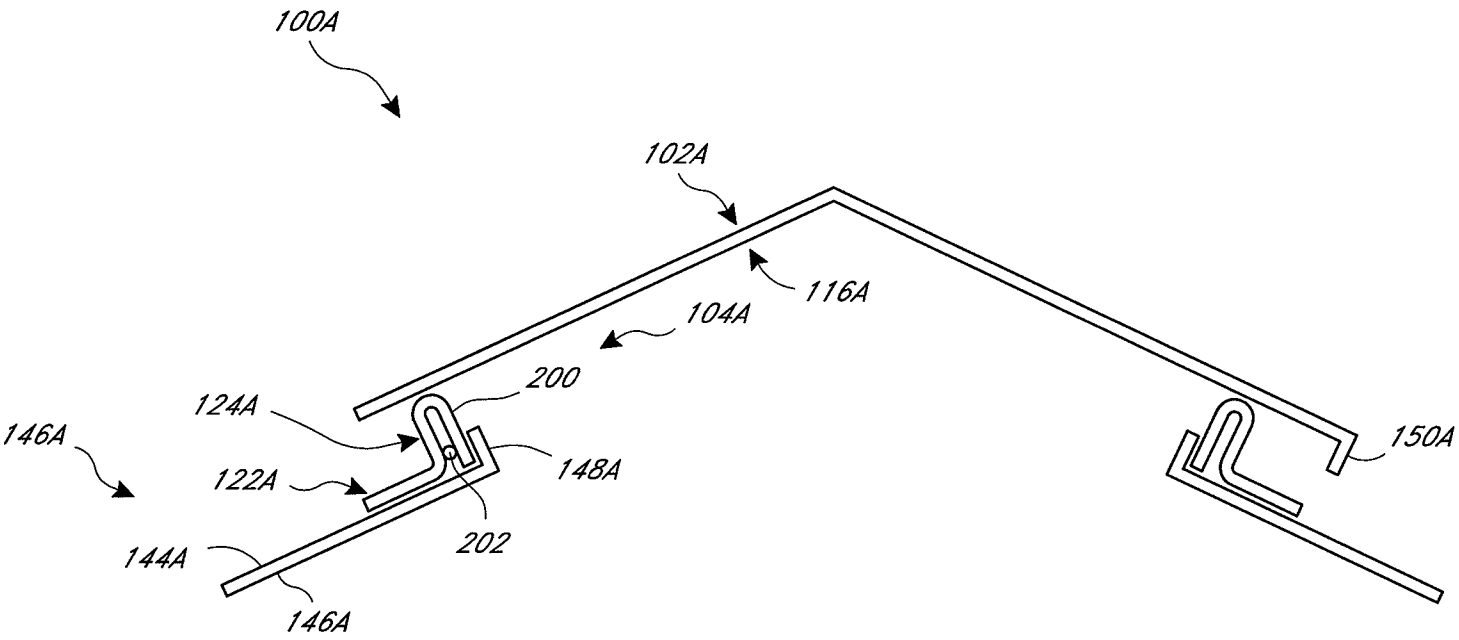
FIG. 7 is an end view of a further embodiment of the vented ridge cap of FIG. 3.

FIG. 7 illustrates a modification of the vented roof cap assembly 100, and is identified by the reference numeral 100A. Components or portions of the vented roof cap assembly 100A, which can be identical or have a similar configuration, have been identified with the same reference numeral used for the corresponding components of the vented roof cap assembly 100, except that the letter "A" has been added thereto.

As illustrated in FIG. 7, the non-continuous member 104A can include a double-layered configuration. For example, the non-continuous member 104 can include a lower flange portion 122A, a first upstanding wall 124A and a second upstanding wall 200.

Such a configuration can provide additional benefits. For example, by using two parallel layers of the non-continuous member 104A which extend transverse to the direction of airflow, additional baffling of the airflow can be provided. This can be beneficial, for example, for preventing wind driven rain from entering the space beneath the roof cap member 102A. Additionally, such as a double-layered configuration of the non-continuous member 104A can provide additional stiffness for the connection between the non-continuous member 104A and the ridge cap member 102A.

Similarly, where the optional mounting member 140A is also attached to the non-continuous member 104A, such a double layered configuration of the non-continuous member 104A also provides further stiffness, further preventing unwanted movement between the mounting portion 140A and the ridge cap member 102A.

In some configurations, additional stiffness can be provided by providing additional attachment points between the first upstanding wall 124A and the second upstanding wall 200. For example, in some embodiments, the walls 124A, 200A can be welded to one another at points spaced apart from the mounting portion 140A and the lower surface 116A of the ridge cap member 102A. Such a weld 202 is schematically illustrated in FIG. 7.

Figure 8:
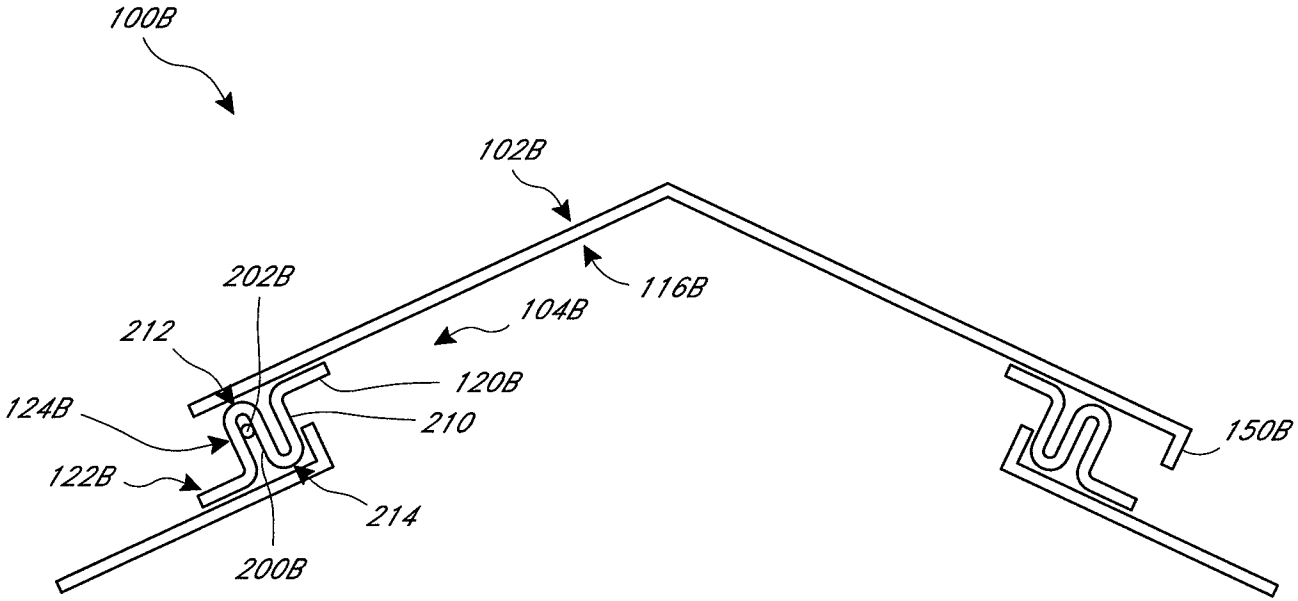
FIG. 8 is a further embodiment of the vented ridge cap of FIG. 1.

FIG. 8 illustrates yet another embodiment of the vented roof cap assembly 100. Components of the vented roof cap assembly 100B that are the same or similar to the corresponding components of the vented roof cap assemblies 100, 100A, are identified with the same reference numeral except a letter "B" has been added thereto, or has been substituted for the letter "A".

As shown in FIG. 8, the non-continuous member 104B can include an additional wall 210, thereby providing three parallel walls extending between the lower surface 116B of the roof cap member 102B and the roof of a structure. As noted above with reference to the vented roof cap assembly 100A, the additional parallel wall 210 can further provide additional stiffness to the completed assembly 100B. Additionally, the additional wall 210, can provide further baffling against unwanted intrusion, such as by wind driven rain. Additional parallel walls can be provided by providing more bends in the material used to form the non-continuous member 104B.

The assembly 100B also is more easily amenable to the inclusion of the upper flange 120B, in that upper and lower flanges 122B, 120B, along with all three walls 124B, 200B, 210, from a single piece of material bent into the illustrated configuration. For example, the non-continuous member 104B can be manufactured from expanded metal run through a rolling device configured to form upper and lower flanges and the bends necessary for forming three parallel walls 124B, 200B, 210.

Additionally, as noted above with reference to the assembly 100A, welds 202B, or other attachment points, can be applied to the non-continuous member 104B to provide additional stiffness to the completed assembly. Further, the three wall configuration of the non-continuous member 104B provides for two additional potential attachment points between the non-continuous member 104B and the ridge cap member 102B at the apexes of the folds 212, 214 between the walls 124B, 200B, 210.

FIGS. 9-14 illustrate yet another embodiment of a vented roof cap assembly 100, identified generally by the reference numeral 100C. Components of the vented roof cap assembly 100C that are the same or similar to the corresponding components of the vented roof cap assemblies 100, 100A, and 100B described above are identified with the same reference numerals except a letter "C" has been added thereto or has been substituted for the letter "A" or "B", accordingly.

Figure 9:
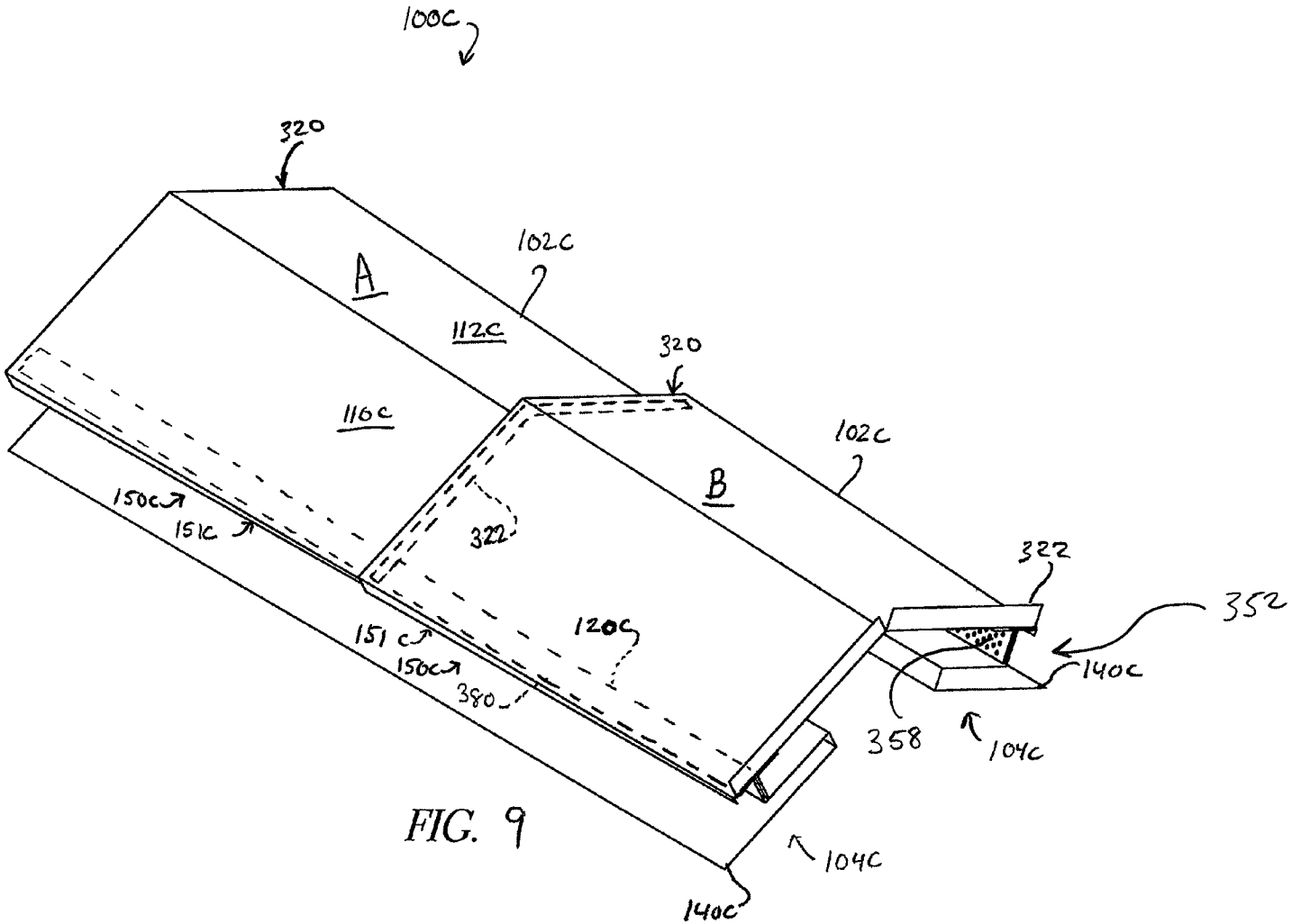
FIG. 9 is a perspective view of a further embodiment of the vented ridge cap of FIG. 1 having dual-tapered cap members and single-piece non-continuous members.
Figure 10:
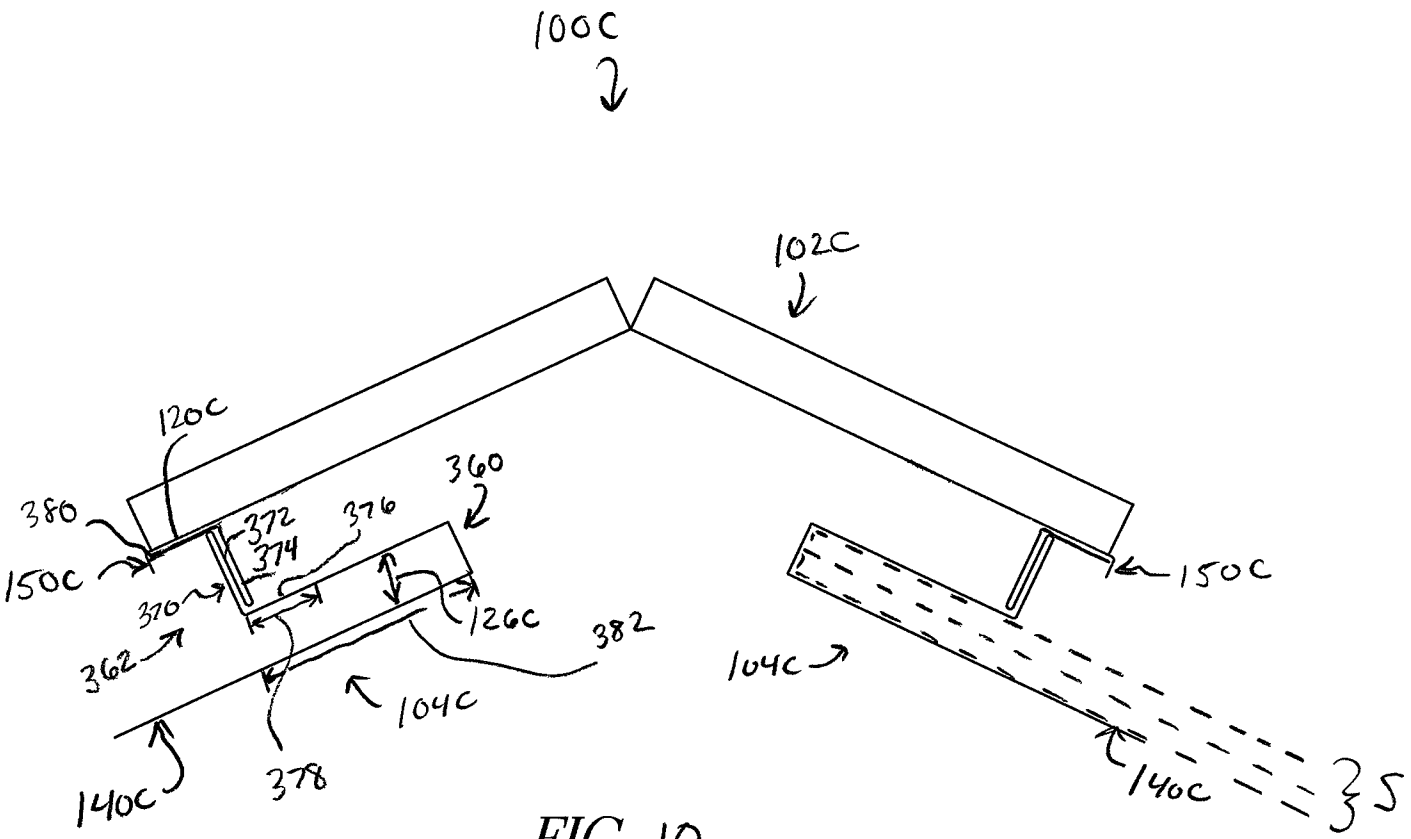
FIG. 10 is an end elevational view of the embodiment of FIG. 9.

With reference to FIGS. 9 and 10, the vented roof assembly 100C includes nesting, dual tapered ridge cap members 102C and non-continuous members 104C that include integrated mounting portions 140C. As such, the non-continuous members 104C can serve as combined ventilation and support means which can also provide flashing.

Figure 11:
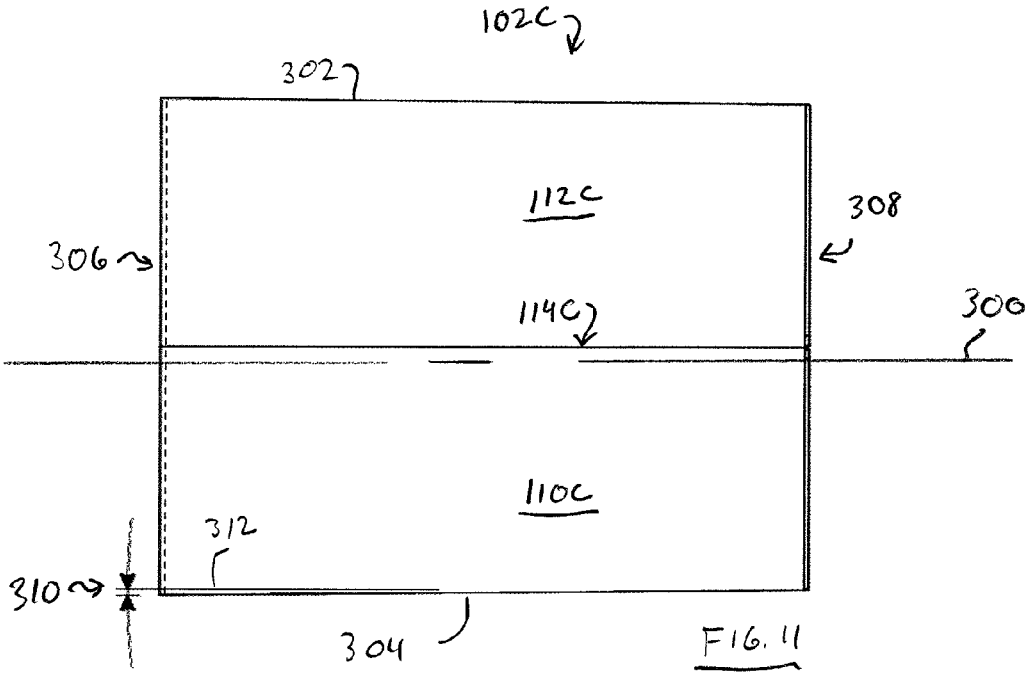
FIG. 11 is a top plan view of a dual-tapered cap member of the embodiment of FIG. 9.
Figure 12:
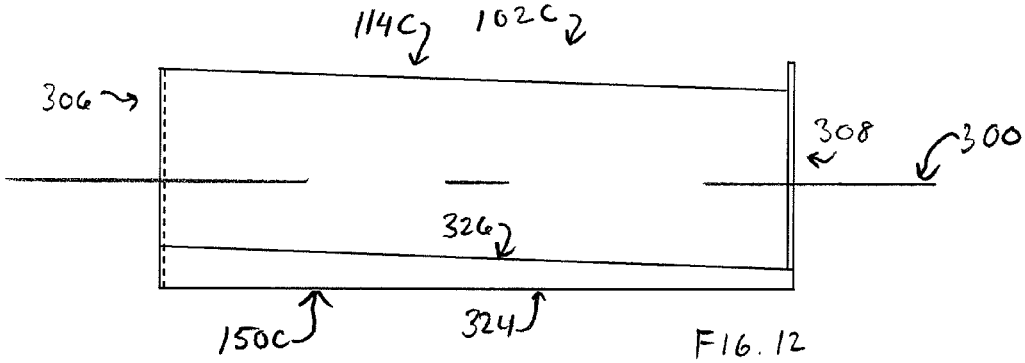
FIG. 12 is a side elevational view of a dual-tapered cap member of the embodiment of FIG. 9.
Figure 13:
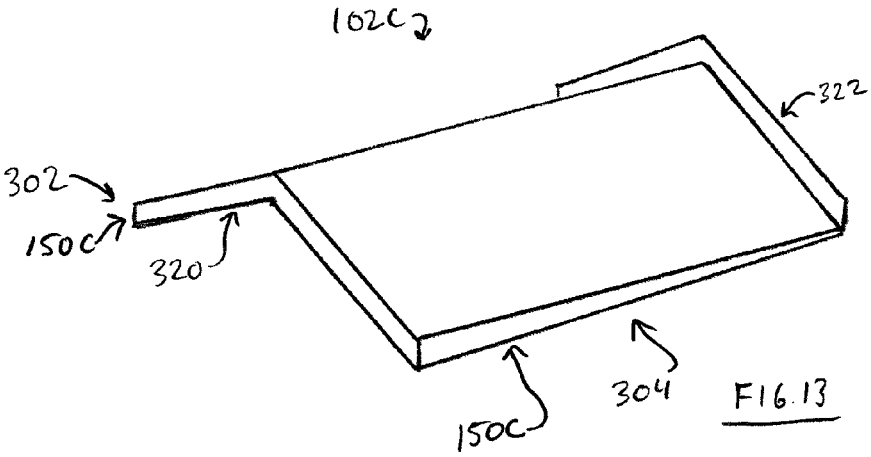
FIG. 13 is a top, front and left side perspective view of the dual-tapered cap member of FIGS. 11 and 12.

With reference to FIGS. 11-13, the cap members 102C, as noted above, can optionally have a dual tapered configuration. In this context, with regard to FIG. 11, the ridge cap members 102C can include a lateral tapering along its longitudinal direction.

For example, the cap member 102C can be considered as extending longitudinally along a longitudinal axis 300. In the orientation illustrated in FIG. 11, the ridge 114C of the ridge cap member 102C can extend coincident with or adjacent to the axis 300. The lateral edges 302, 304 can be tapered so as to extend slightly inwardly (i.e., toward the axis 300) in the direction from a front end 306 of the cap member 102C to the rear end 308 of the cap member 102C. For example, in some embodiments, where the ridge cap member 102C has an overall length, along the direction of the axis 300, that is about equivalent to the length of the visible portion of shingles along a roof ridge, the taper identified by the referenced numeral 310 can be about one to five degrees, when measured relative to a line 312 that is parallel to the longitudinal axis 300. Other angles can also be used.

With reference to FIG. 12, the ridge cap member 102C can also be tapered in a vertical direction. For example, the height of the ridge 114C at the front end 306 of the ridge cap member 102C can be higher than the vertical height of the ridge 114C at the rear end 308. In some embodiments, the difference in height of the ridge 114C between the front end 306 and the rear end 308 can be approximately one-half of an inch, where the length of the ridge 114C is about 10". However, other sizes can also be used.

Having one or more tapers, such as the lateral and vertical tapers noted above with reference to FIGS. 11 and 12, the ridge cap member 102C can facilitate nesting in an end-to-end fashion, described in greater detail below with reference to FIG. 9.

With reference to FIG. 13, the ridge cap member 102C can also include a downward flange 320 extending downwardly from the front end 306. Additionally, the ridge cap member 102C can include an upward flange 322.

The flanges 320, 322 can also further provide benefits with regard to connecting ridge cap members 102C in a nesting, end-to-end fashion, described below. Additionally, the lateral edges 302, 304 of the ridge cut member 102C can include downwardly extending lips 150C.

As shown in FIGS. 12 and 13, the vertical height of the lips 150C is greater at the front end 302 of the ridge cut members 102C and smaller at the rear end 322. This is due to the vertical taper described above with regard to FIG. 12. As such, the lower most edge 324 of the lip 150C (FIG. 12) can be generally horizontal or when installed on a horizontal roof, or parallel to the longitudinal axis 300. The uppermost edge 326 of the lip 150C, on the other hand, tapers downwardly from the front edge 306 to the rear edge 308. This configuration is more easily produced when using bent sheet metal to form the ridge cap member 102C. Other configurations can also be used.

The front flange 320 and the rear flange 322 are shaped and configured to accommodate one another, when longitudinally arranged ridge cap members 102C are interleaved and connected to each other in an end-to-end fashion.

For example, as shown in FIG. 9, two ridge cap members 102C are interleaved and connected to each other in an end-to-end fashion. For ease of description, one of the ridge cap members 102C is labeled as ridge cap member A and the other ridge cap member 102C is labeled as B. As shown in FIG. 9, the rear flange 322 of ridge cut member A is underneath and covered by the forward end 306 of ridge cap member B.

More specifically, the front flange 320 of ridge cap member B extends over and downwardly in front of the rear flange 322 of the ridge cap member A. In this interleaved engagement between the ridge cap members A and B, because of the upward extension of the rear flange 322, water is prevented from flowing past the upward flange 322 of ridge cap member A and is thus guided downwardly along the lateral sides 110C, 112C of the ridge cap member A. Additionally, the tapers noted above, including the lateral taper and the vertical taper, allow the forward end 306 of the ridge cap member B to receive the rear end 308 of the ridge cap member A. Thus, an unrestricted number of ridge cap members 102C can be connected in the end-to-end fashion as illustrated in FIG. 9.

With regard to the non-continuous member 104C, as noted above, these members 104C can include an integrated mounting portion 140C. In some embodiments, the integration of the mounting portion 140C with the non-continuous member 104C can be accomplished by making the entire non-continuous member 104C from a single piece of sheet metal bent into the configurations illustrated in FIGS. 9 and 10.

Figure 14:
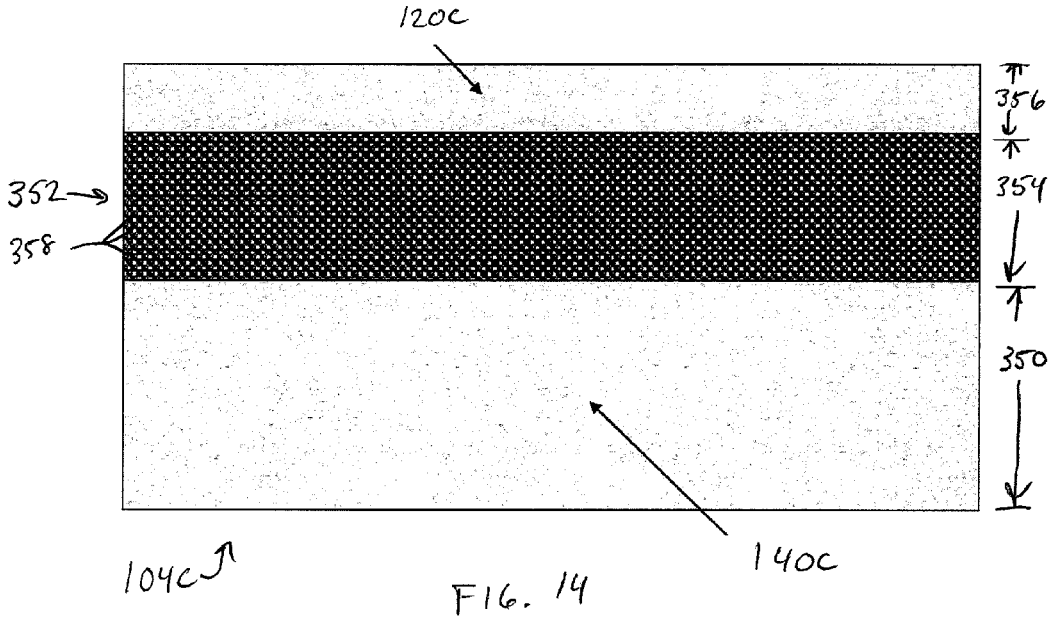
FIG. 14 is a plan view of an integrated mounting and non-continuous member of the embodiment of FIGS. 9 and 10, in an unfolded state.

For example, as shown in FIG. 14, the non-continuous member 104C can be constructed starting with standard gauge thickness steel in a rectangular shape. For example, in some embodiments, the non-continuous member 104C can include the mounting portion 140C having a width 350 of about five inches, a non-continuous portion 352 having holes 358 in an area having a width 354 of about three inches and an upper mounting portion 120C having a width 356 of about one inch. The above-noted dimensions are examples of dimensions that can be used. Other dimensions can also be used.

The non-continuous portion 352 can be formed by drilling or punching a series of small diameter holes (e.g., $1/16^{th}$ of an inch in diameter) in a spaced/offset pattern (e.g., 3/16" apart). Other techniques, holes sizes, shapes, and spacings can also be used.

With continued reference to FIGS. 9 and 10, the non-continuous member 104C illustrated in FIG. 14 can be bent into the configuration illustrated in FIGS. 9 and 10, with any known technique. In the illustrated embodiment, the non-continuous member 104C is bent so as to provide the mounting portion 104C, a slot portion 360 defining a slot with 126C, a baffle portion 362 and the upper flange portion 120C. Where the non-continuous member 104C is made from sheet metal described above with reference to 14, such sheet metal can be bent with any known technique.

As noted above, the spacing 126C can be any desired size. In some embodiments, the spacing 126C can be approximately one-half an inch. At such a spacing, the slot portion 360 can accommodate two layers of standard composite shingle from several different manufacturers, which accommodates a preferred manner of installing the present ridge cap assemblies 100.

In the illustrated embodiment, as shown in FIGS. 9 and 10, the non-continuous member 104C extends from the slot portion 360, toward the baffle portion 362 to first define an outermost wall 370 of the baffle portion 362. This outermost wall 370, as well as first and second inner walls 372, 374 can all be made from the non-continuous portion 352 (FIG. 14) of the non-continuous member 140C. The illustrated embodiment includes three walls extending generally perpendicular to the mounting portion 140. However other numbers of walls can also be used.

With continuing reference to FIG. 10, the upper flange portion 120C extends from the uppermost portion of the innermost wall 374, over the first inner wall 372 and the outermost wall 370 to an outermost edge 380 of the flange 120C. The outermost edge 380 of the flange 120C, when assembled with ridge cap members 102C, can lie juxtaposed to, closely spaced to, or in contact with the lip 150C, at approximately the lowermost edge 151C of the lip 150C.

With reference to FIG. 9, in this configuration, the outermost edge 380 of the flange 120C extends along the axially aligned lips 150C of longitudinally connected ridge cap members 102C (A, B). Thus, the upper flange 120C can provide a substantially or completely sealed engagement with the serially aligned lips 150C of the serially attached ridge cap members 102C, which include undulations in gaps in the vicinity where the front and rear ends 306, 308 attach to each other, as described above.

In the illustrated embodiment, the outermost wall 370 and the first and second inner walls 372, 374 form three layers of overlapping, non-continuous walls which provide protection against wind driven rain as well as allow ventilation of air from a roof disposed beneath the assembly 100C.

Optionally, with reference to FIG. 10, the baffle portion 362 can also include a portion 376 extending generally perpendicular to the outermost wall 370. For example, the perpendicular portion 376 of the baffle portion 362 can have a length 378 of about three-quarters of an inch. However, other sizes can also be used.

This embodiment can be provided with the non-continuous portion 352 (FIG. 14) is approximately three inches wide and the height of each of the walls 370, 372, 374 is approximately three-quarters of an inch and the portion 376 is also three-quarters of an inch long.

During installation of the assembly 100C, non-continuous members 104C can be mounted on opposite sides of a roof ridge 16 (FIGS. 1 and 2). For example, the mounting portions 140C can be glued, screwed, or nailed to sheathing members 12, 14. In order to ensure the correct spacing of the non-continuous members 104C, one or more ridge cap members 102C can be used as templates for achieving the correct spacing of the non-continuous members 104C. For example, the ridge cap members 102C can be laid on top of the roughly positioned non-continuous members 104C and resting on the flanges 120C under its own weight.

After the mounting portions 140C are secured to the sheathing members 12, 14 a series of ridge cap members 102C can be serially connected to each other and connected to the flanges 120C, in the configuration shown in FIG. 9. Optionally, the ridge cap members 102C can be nailed, screwed, or glued to the flanges 120C. Other techniques can also be used.

As noted above, the slot portion 360 can accommodate multiple layers (e.g., two layers) of typical composite roof shingles S (phantom line, FIG. 10). The installation of such shingles can be performed using techniques well known in the art.

As noted above, with the optional perpendicular portion 376 of the baffle portion 362, the assembly 100C provides for both horizontal and vertical ventilation, i.e., lateral ventilation through the vertical walls 370, 372, 374, and vertical ventilation through wall 376. Such dual ventilation can provide for more optimal air flow. In some embodiments, the non-continuous portion 352 (FIG. 14) which forms the walls 370, 372, 374, 376 can be perforated, punched or drilled in such a way to provide approximately 40% or more open area of its overall surface area.

Additionally, using a standard pattern for the holes forming the non-continuous portion 352 (FIG. 14) and folding the non-continuous portion 352 at least three times as illustrated in FIG. 10, results in an offset configuration of the overlapping walls 370, 372, 374 which provides a beneficial diversion of wind driven rain. Additionally, by providing at least three folds, considerable additional strength is provided. If desired, polyester or additional batting can be included between the walls 370, 372, 374 (not shown). This configuration can also be easily adapted for hip areas of a roof.

With reference to FIG. 10, in some embodiments, the depth 382 of the slot portion 360 can be approximately one and three-quarters inch. However, other depths can also be used.

Using a such a depth can beneficially provide for better protection of the fasteners used to secure the mounting portion 140C to sheathing members 12, 14. For example, by allowing for such a depth of the slot portion 360, standard composite roofing shingles S (FIG. 14) can be inserted sufficiently deep into the slot portion 360 so as to completely cover any fasteners used to secure the mounting portion 140C to the sheathing members 12, 14.

Additionally, two non-continuous members 104C and a plurality of ridge cap members 102C can be preassembled, for example, in a factory and shipped to a site in a desired length. As such, the entire assembly can be rapidly installed onto a roof. Additionally, individual pieces of non-continuous member 104C and ridge cap members 102C can also be delivered to a construction site to provide for on-site assembly and installation. For example, such separate pieces can be used for smaller portions of the roof that have not been spaced or to accommodate miscalculations or errors in sizing.

The configuration of the non-continuous members 104 also provide accommodation for roofs having different pitches. For example, the designs of the roof cap assemblies 100 noted above can accommodate roof pitches as low as about 2/12 (9.5 degrees) up to 12/12 (45 degrees) with satisfactory performance.

As noted above, the roof cap members 102C can be tapered in two directions, laterally and vertically. As such, the ridge cap members 102C taper from front to back creating a broader front and a narrower back giving the caps 102C depth on the horizontal line; while also tapering the sides from a wider front to a narrower back on a vertical line, providing each cap 102C with an appearance of singular components and having an appearance that looks like conventional ridge caps. In some embodiments, the entire assembly 100 can be produced from galvanized steel, for example, commercially available under the trade name "Galva-lume."

As noted above, the ridge cap members 102, 102A, 102B, 102C can include an exterior finish, of any desired appearance. For example, the upper surface of the ridge cap members 102, 102A, 102B, 102C can be provided with an exterior finish that matches the shingles S, or any other desired roofing material 115. Similarly, the mounting portions 140 can also be provided with a matching exterior finish on the upper surface 144, if the vented roof cap assembly 100 is intended to be installed with the mounting portions 140 on top of adjacent roofing material.

As such, the roof cap assemblies 100, 100A, 100B, 102C can be manufactured so as to be fully prefinished, and transported to the construction site in a finished state. As such, installers enjoy a reduced installation time.

What is claimed is:

1. A vented roofing cap comprising:

a peaked cap member having a peaked middle portion and first and second lateral sides extending downwardly from the peaked middle portion;

a first ventilation and flashing member made from a single piece of material, the first ventilation and flashing member including a first leg portion comprising a first upper end connected to the first lateral side of the peaked cap member, the first leg portion extending downwardly from the first lateral side of the peaked cap member to a lower end of the first leg portion, the first leg portion including at least a plurality of parallel layers between the first upper end and the first lower end of the first leg portion, each of the plurality of parallel layers including one or more apertures sufficiently large to accommodate ventilation air flow therethrough, the first ventilation and flashing member including a first channel portion having a first upper wall, an end wall, and a first lower wall, the first upper wall having a first end connected to the first lower end of the first leg portion, the first upper wall extending from the first end, toward the peaked middle portion of the peaked cap member wall, to a second end of the first upper wall, the end wall of the first channel portion connecting the second end of the first upper wall with a first end of the first lower wall with the second end of the first upper wall in the first end of the first lower wall spaced apart by the end wall, the first lower wall extending from the first end of the first lower wall, away from the peaked middle portion to a second end of the first lower wall positioned outwardly from the plurality of parallel layers of the first leg portion; and a second ventilation and flashing member fixed to the second lateral side of the peaked cap member, the second ventilation and flashing member being made of a single piece of material and including a second leg portion having an upper end connected to the second lateral side of the peak cap member, the second leg portion comprising a plurality of parallel layers, each including at least one aperture sufficiently large to accommodate ventilation air flow therethrough, and a second channel portion connected to a lower end of the second leg portion.

2. The vented roofing cap of claim 1, wherein the first leg portion comprises sheet material with the plurality of apertures, the first leg portion including an upper edge connected to the first lateral edge of the peaked cap member.

3. The vented roofing cap of claim 2, wherein the first leg portion comprises a middle portion and a lower portion, the middle portion including at least one fold forming at least two layers of juxtaposed sheet material, each layer having apertures accommodating ventilation air flow therethrough.

4. The vented roofing cap of claim 2, wherein the sheet material comprises non-continuous material.

5. The vented roofing cap of claim 1, wherein the first channel portion forms a recess sized to receive at least one layer of roofing material.

6. The vented roof cap of claim 1, wherein the peaked cap member is stone coated.

7. The vented roofing cap of claim 1, wherein the first upper wall of the first channel portion includes one or more apertures sufficiently large to allow ventilation flow therethrough in a direction transverse to a direction of ventilation flow through the one or more apertures of the first leg portion.

8. The vented roofing cap of claim 1, wherein the first lateral side of the peaked cap member comprises a downwardly extending lateral edge, wherein the first leg portion comprises an upper end connected to the first lateral side at a position spaced inwardly from the downwardly extending lateral edge.

9. The vented roofing cap of claim 1, wherein the peaked cap member includes first and second longitudinal ends, the first longitudinal end including a downwardly extending lip and the second longitudinal end comprising an upwardly extending lip.

10. The vented roofing cap of claim 9, wherein the downwardly extending lip and the upwardly extending lip are configured to allow a plurality of the vented roofing cap to be engaged in an end-to-end fashion, the downwardly extending lip of one vented roofing cap extending over the upwardly extending lip of an adjacent vented roofing cap.

11. A roofing cap comprising:

a peaked cap member having a peaked middle portion extending along a longitudinal direction of the peaked cap member and first and second lateral sides extending downwardly from the peaked middle portion, the peaked cap member also comprising first and second longitudinal ends;

a first downwardly extending lip disposed at the first longitudinal end of the peaked cap member;

a second upwardly extending lip disposed at the second longitudinal end of the peaked cap member;

wherein the first longitudinal end of the peaked cap member is larger than the second longitudinal end of the peaked cap member, in at least first and second dimensions, such that the first longitudinal end of the peaked cap member is large enough to fit over the second longitudinal end;

a first ventilation and flashing member extending downwardly from the first lateral side of the peaked cap member, the first ventilation and flashing member including a first wall extending downwardly and transverse to the first lateral side of the peaked cap member ending including a plurality of apertures sized sufficiently to allow ventilation therethrough and a first channel portion connected to a lower end of the first wall, the first channel portion defining a recess extending upwardly toward the peaked middle portion and opening in a direction facing outwardly away from the peaked middle portion, the first channel portion including a first lower wall extending outwardly from the first wall; and a second ventilation and flashing member extending downwardly from the second lateral side of the peaked cap member, the second ventilation and flashing member including a second wall extending downwardly and transverse to the second lateral side of the peaked cap member and including a plurality of apertures sized sufficiently to allow ventilation therethrough and a second channel portion connected to a lower end of the second wall, the second channel portion defining a second recess extending upwardly toward the peaked middle portion and opening in a direction facing outwardly away from the peaked middle portion, the second channel portion including a second lower wall extending outwardly from the second wall.

12. The roofing cap according to claim 11, wherein the first lateral side comprises a first outermost lateral edge and the first dimension is height, the roofing cap further comprising a first lateral lip extending downwardly from the first outermost lateral edge, the first lateral lip extending between the first longitudinal end and the second longitudinal end, the first lateral lip having a first height in the vicinity of the first longitudinal end and a second height in the vicinity of the second longitudinal end, the first height being greater than the second height.

13. The roofing cap according to claim 12, wherein the first lateral lip is shaped such that a height of the first lateral lip changes gradually between the first and second longitudinal ends and extends through the first height and the second height.

14. The roofing cap according to claim 13, wherein the second dimension is width, wherein the first lateral lip extends from the first longitudinal end to the second longitudinal end and partially inwardly towards the peaked middle portion.

15. The roofing cap according to claim 14, where the first lateral lip is spaced from the peaked middle portion at a first lateral spacing in a vicinity of the first longitudinal end and is spaced from the peaked middle portion at a second lateral spacing in a vicinity of the second longitudinal end, the first lateral spacing being larger than the second lateral spacing.

16. The roofing cap according to claim 14, wherein a lateral spacing between the first lateral lip and the peaked middle portion changes gradually along the first lateral lip, in the longitudinal direction.

17. The roofing cap according to claim 13, wherein the first lateral lip includes a first upper edge extending along and connected to the first outermost lateral edge of the first lateral side between the first and second longitudinal ends, the first lateral lip also comprising a first lower edge extending between the first and second longitudinal ends, the first lower edge being non parallel with the first upper edge.

18. The roofing cap according to claim 17, wherein a longitudinal axis of the roofing cap extends parallel with the first lower edge of the first lateral lip, each of the first upper edge, first lateral side, second lateral side, and the peaked middle portion are non parallel with the longitudinal axis.

19. The roofing cap according to claim 11 additionally comprising a support member having an upper end connected to the first lateral side and a lower end configured to be fixable to a roof of a structure so as to support the peaked cap member at a position spaced above the roof of the structure with a gap between a lower most edge of the first lateral side and the roof structure, the support member comprising a ventilation portion comprised of non-continuous sheet material arranged into a plurality of juxtaposed layers configured to accommodate restricted airflow therethrough.

* * * * *